US007551193B2

(12) United States Patent
Koike

(10) Patent No.: US 7,551,193 B2
(45) Date of Patent: Jun. 23, 2009

(54) ELECTRO-OPTICAL APPARATUS, IMAGE-FORMING APPARATUS AND METHOD OF MANUFACTURING ELECTRO-OPTICAL APPARATUS

(75) Inventor: Shigemitsu Koike, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 332 days.

(21) Appl. No.: 11/677,826

(22) Filed: Feb. 22, 2007

(65) Prior Publication Data

US 2007/0236554 A1 Oct. 11, 2007

(30) Foreign Application Priority Data

Mar. 24, 2006 (JP) ..... 2006-082256

(51) Int. Cl.
*B41J 2/447* (2006.01)
*B41J 2/45* (2006.01)

(52) U.S. Cl. ..... 347/238

(58) Field of Classification Search ..... 347/130, 347/238

See application file for complete search history.

(56) References Cited

U.S. PATENT DOCUMENTS 4,905,021 A * 2/1990 Iizuka et al. ..... 347/237
5,291,039 A * 3/1994 Ogata et al. ..... 257/99
5,403,102 A * 4/1995 Yokoyama ..... 400/175
6,025,863 A * 2/2000 Nakajima et al. ..... 347/238
7,161,611 B2 * 1/2007 Hyuga et al. ..... 347/238
7,443,412 B2 * 10/2008 Seo ..... 347/238
2006/0132644 A1 * 6/2006 Shangguan et al. ..... 348/374
2007/0040888 A1 * 2/2007 Seo ..... 347/238
2008/0106590 A1 * 5/2008 Koizumi et al. ..... 347/238

FOREIGN PATENT DOCUMENTS

JP A 63-103288 5/1988
JP A 2004-58448 2/2004

* cited by examiner

*Primary Examiner*—Huan H Tran
(74) *Attorney, Agent, or Firm*—Oliff & Berridge, PLC

(57) ABSTRACT

An electro-optical apparatus including: an electro-optical panel on which a plurality of electro-optical devices are arranged; a focusing lens which focuses light emitted from the electro-optical devices; an optically transparent spacer which is interposed between the electro-optical panel and the focusing lens and contacts the electro-optical panel and the focusing lens; and a frame which has a first facing surface facing a first surface which is a surface of the spacer on the side of the focusing lens, wherein the first surface contacts the first facing surface.

11 Claims, 6 Drawing Sheets

ELECTRO-OPTICAL APPARATUS, IMAGE-FORMING APPARATUS AND METHOD OF MANUFACTURING ELECTRO-OPTICAL APPARATUS

BACKGROUND

1. Technical Field

The present invention relates to an electro-optical apparatus having an electro-optical panel on which electro-optical devices such as organic light-emitting diodes are arranged, a method of manufacturing the electro-optical apparatus and an image-forming apparatus using the electro-optical apparatus.

2. Related Art

An electrophotographic image-forming apparatus using an electro-optical panels on which a plurality of electro-optical devices are arranged, as an exposure head of a photosensitive body has been suggested. For example, JP-A-63-1032-88 and JP-A-2004-58448 disclose a configuration in which a focusing lens array for focusing light emitted from electro-optical devices is provided in a gap between an electro-optical panel and a photosensitive body.

SUMMARY

In the above configuration, a space (air layer) having a dimension substantially equal to an operating distance on an object side of the focusing lens array needs to be ensured between the focusing lens array and the electro-optical panel. Since the light which is emitted from the electro-optical devices and propagates through the space is diffused, it is difficult to ensure the amount of light incident to the focusing lens array is sufficient among the light emitted from the electro-optical devices (that is, the use efficiency of the light is low). Under such circumferences, an advantage of the invention is to reduce loss of light emitted from electro-optical devices.

According to an aspect of the invention, there is provided an electro-optical apparatus including: an electro-optical panel on which a plurality of electro-optical devices are arranged; a focusing lens array which focuses light emitted from the electro-optical devices; an optically transparent spacer which is interposed between the electro-optical panel and the focusing lens array and contacts the electro-optical panel and the focusing lens array; and a frame which has a first facing surface facing a first surface which is a surface of the spacer on the side of the focusing lens array, wherein the first surface contacts the first facing surface.

According to the electro-optical apparatus of the invention, since the spacer is disposed in a gap between the electro-optical panel and the focusing lens array, it is possible to improve the use efficiency of the light emitted from the electro-optical panel, compared with a configuration in which an air layer is interposed in the gap between the electro-optical panel and the focusing lens array. In the above configuration, the distance between the electro-optical panel and the focusing lens array, both of which contact the spacer, is defined by the dimension of the spacer in an optical axis of the electro-optical devices. Accordingly, when the dimension of the spacer is properly selected, it is possible to set the distance between the electro-optical panel and the focusing lens array to a predetermined value in the step of disposing the spacer. When the first surface of the spacer contacts the first facing surface of the frame, the position of the spacer relative to the frame is defined. Since the focusing lens array and the electro-optical panel contact the spacer with the spacer interposed therebetween, the positions of the focusing lens array and the electro-optical panel relative to the frame are defined. Accordingly, according to the invention, it is possible to simply set the positions of the focusing lens array and the electro-optical panel in a direction (a direction perpendicular to the first surface and, hereinafter, referred to as a "Z direction") of the optical axis of the focusing lens array to predetermined values with high precision. When error in the dimension of the spacer is smaller than that of the frame, it is possible to provide the electro-optical panel with high precision, compared with a configuration in which the position of the electro-optical panel is defined on the basis of the surface of the frame.

The electro-optical device is a component in which optical characteristics such as brightness or a transmission factor vary depending on the application of electric energy (for example, the supply of current or the application of a voltage). The electro-optical device according to the invention includes a light-emitting device (for example, an electroluminescence device or a plasma display device) for emitting light by applying electric energy and a light modulation device (for example, a liquid crystal device or an electrophoretic device) for changing a transmission factor by applying electric energy.

In a suitable aspect of the invention, a recess (for example, a recess 40*c*) having the first facing surface as a bottom is formed in the frame and the spacer is inserted into the recess. In this state, the spacer is disposed such that the second surface opposite to the first surface protrudes from the recess to the electro-optical panel. That is, the distance from the first facing surface to the surface (for example, the surface 405) of the frame on the side of the electro-optical panel (the depth of the recess) is set to be smaller than the thickness of the spacer. In other words, when viewed from the electro-optical panel, the surface of the frame on the electro-optical panel is positioned at the inside of the second surface of the spacer. Accordingly, the electro-optical panel contacts only the second surface of the spacer so as not to contact the surface of the frame on the side of the electro-optical panel. By this configuration, it is possible to set the position of the electro-optical panel by only the thickness of the spacer with high precision.

The depth of the recess may be substantially equal to or larger than the thickness of the spacer. In this configuration, the electro-optical panel contacts both the second surface of the spacer and the surface of the frame on the side of the electro-optical panel or only the surface of the frame on the side of the electro-optical panel. Accordingly, the position of the electro-optical panel relative to the focusing lens array is defined by the position of the surface of the frame on the electro-optical panel. According to this aspect, it is possible to simply dispose the electro-optical panel at a predetermined position with high precision by properly selecting the position of the surface of the frame on the electro-optical panel.

In a suitable aspect of the invention, the frame has a second facing surface (for example, a second facing surface 402) facing a side surface (for example, a side surface 202) of the spacer and the second facing surface contacts the side surface of the spacer. According to this aspect, since the second facing surface contacts the side surface of the spacer, it is possible to simply position the spacer in a plane (an X-Y plane in FIGS. 1 to 3) perpendicular to the Z direction with high precision by inserting the spacer into the recess (for example, the recess 40*c*) defined by the first facing surface and the second facing surface.

In a suitable aspect of the invention, the frame has a third facing surface (for example, a third facing surface 403) facing a side surface of the focusing lens array and the third facing surface contacts the side surface of the focusing lens array. The position of the focusing lens array in the Z direction is defined by the contact with the first surface of the spacer and the position of the focusing lens array in the plane perpendicular to the Z direction is defined by the position of the third facing surface. Accordingly, it is possible to simply dispose the focusing lens array at a predetermined position by properly selecting the position of the third facing surface.

In a suitable aspect of the invention, the frame has a fourth facing surface facing a side surface of the electro-optical panel and the fourth facing surface contacts the side surface of the electro-optical panel. In this aspect, it is possible to dispose the electro-optical panel at a predetermined position in the plane parallel to a device arrangement surface by properly selecting the position of the fourth facing surface.

In a suitable aspect of the invention, the spacer is bonded to at least any of the first and second facing surfaces. By this configuration, stronger fixation is possible, compared with a configuration in which the spacer only contacts the frame.

In a suitable aspect of the invention, the spacer is bonded to at least any of the electro-optical panel and the focusing lens array. By this configuration, stronger fixation is possible, compared with a configuration in which the electro-optical panel and the focusing lens array are not bonded to the spacer. In addition, since the contact surface between the spacer and the electro-optical panel is bonded, it is possible to prevent the electro-optical panel to be curved due to heat generation of the electro-optical device.

According to another aspect of the invention, there is provided a method of manufacturing an electro-optical apparatus, which includes an electro-optical panel on which a plurality of electro-optical devices are arranged; a focusing lens array which focuses light emitted from the electro-optical devices; an optically transparent; spacer which is interposed between the electro-optical panel and the focusing lens array and contacts the electro-optical panel and the focusing lens array; and a frame which has a first facing surface facing a surface which is a surface of the spacer on the side of the focusing lens array, including a first step of allowing a first surface which is the surface of the spacer on the side of the focusing lens array to contact the first facing surface; and a second step of allowing a second surface which is a surface of the spacer on the side of the electro-optical panel to contact the electro-optical panel and allowing the focusing lens array to contact the first surface. According to the manufacturing method, the position of the spacer in the Z direction is defined by allowing the spacer to contact the first facing surface of the frame in the first step. Since the distance between the electro-optical panel and the focusing lens array is defined by the thickness of the spacer, the electro-optical panel and the focusing lens array are disposed at predetermined positions by only allowing the electro-optical panel and the focusing lens array to contact the spacer.

In a suitable aspect of the invention, the frame of the electro-optical apparatus has a second facing surface facing a side surface of the spacer and the side surface of the spacer contacts the second facing surface in the first step. According to this aspect, both the surface and the side surface of the spacer contact the frame in the first step. That is, it is possible to position the spacer by inserting the spacer into the recess formed by the first facing surface and the second facing surface.

In a suitable aspect of the invention, the spacer is bonded to at least any of the first and second facing surfaces of the frame in the first step. In addition, at least any of the electro-optical panel and the focusing lens array is bonded to the spacer in the second step. Accordingly, the fixation between the components is stronger and a phenomenon that the electro-optical panel is curved due to heat generation of the electro-optical device can be prevented.

The electro-optical apparatus related to the invention is used a variety of electronic apparatuses. The electronic apparatus includes an image-forming apparatus using the electro-optical apparatus in exposure of an image carrier such as a photosensitive drum. The image-forming apparatus includes an image carrier; a charger which charges the image carrier; an electro-optical apparatus which irradiates light emitted from electro-optical devices onto a charged surface of the image carrier to form a latent image; a developer which forms a developed image on the image carrier by attaching a developing agent to the latent image; and a transfer unit which transfers the developed image from the image carrier to another object. The use of the electro-optical apparatus is not limited to the exposure. The electro-optical apparatus according to the invention can be used to illuminate an original. An image reading apparatus includes the electro-optical apparatus of the invention and a light-receiving device (for example, a light-receiving element of a charge coupled device (CCD) or the like) for converting light irradiated from the electro-optical apparatus and reflected from a read target (original) into an electric signal. The electro-optical apparatus on which the electro-optical devices are arranged in a matrix is used as a display device of a variety of electronic apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Electro-Optical Apparatus

Figure 1:
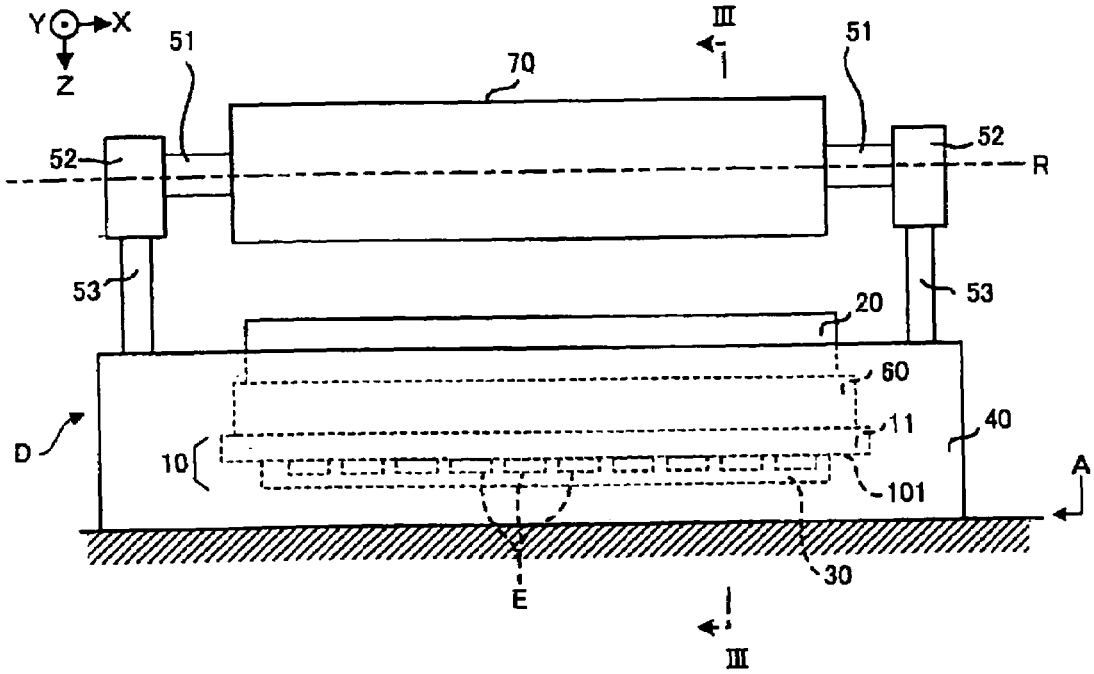
FIG. 1 is a side view showing the configuration of an electro-optical apparatus and a peripheral device related to an embodiment of the invention.

FIG. 1 is a side view showing the configuration of an electro-optical apparatus D and a peripheral device according to an embodiment of the invention. The electro-optical apparatus D is used as a line-type optical head in an electrophotographic image-forming apparatus, which irradiates light onto a photosensitive drum 70 of an image carrier, to form a latent image. As shown in FIG. 1, the photosensitive drum 70 is provided at a position spaced apart from a specific surface (hereinafter, referred to as an installation surface) A of a housing of the image-forming apparatus by a predetermined interval and rotates around a central axis R which extends in an X direction (a main scanning direction). The electro-optical apparatus D is provided on the installation surface A to be positioned in a gap between the photosensitive drum 70 and the installation surface A.

Figure 2:
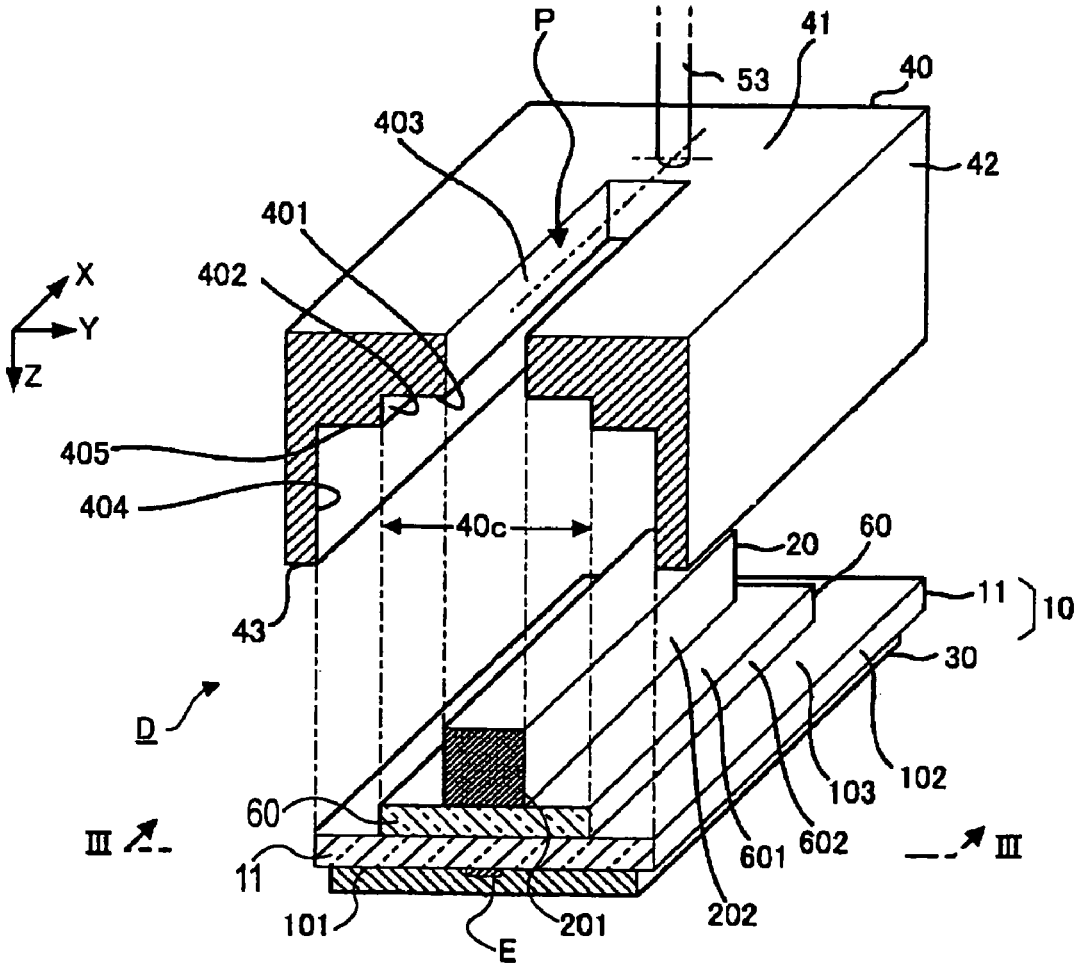
FIG. 2 is an exploded perspective view showing the configuration of the electro-optical apparatus.

FIG. 2 is an exploded perspective view showing the configuration of the electro-optical apparatus D shown in FIG. 1. As shown in FIG. 2, the electro-optical apparatus D includes an electro-optical panel 10, a focusing lens array 20, and glass spacer 60. The focusing lens array 20 is positioned in a gap between the photosensitive drum 70 and the electro-optical panel 10. The glass spacer 60 is positioned in a gap between the focusing lens array 20 and the electro-optical panel 10.

Figure 3:
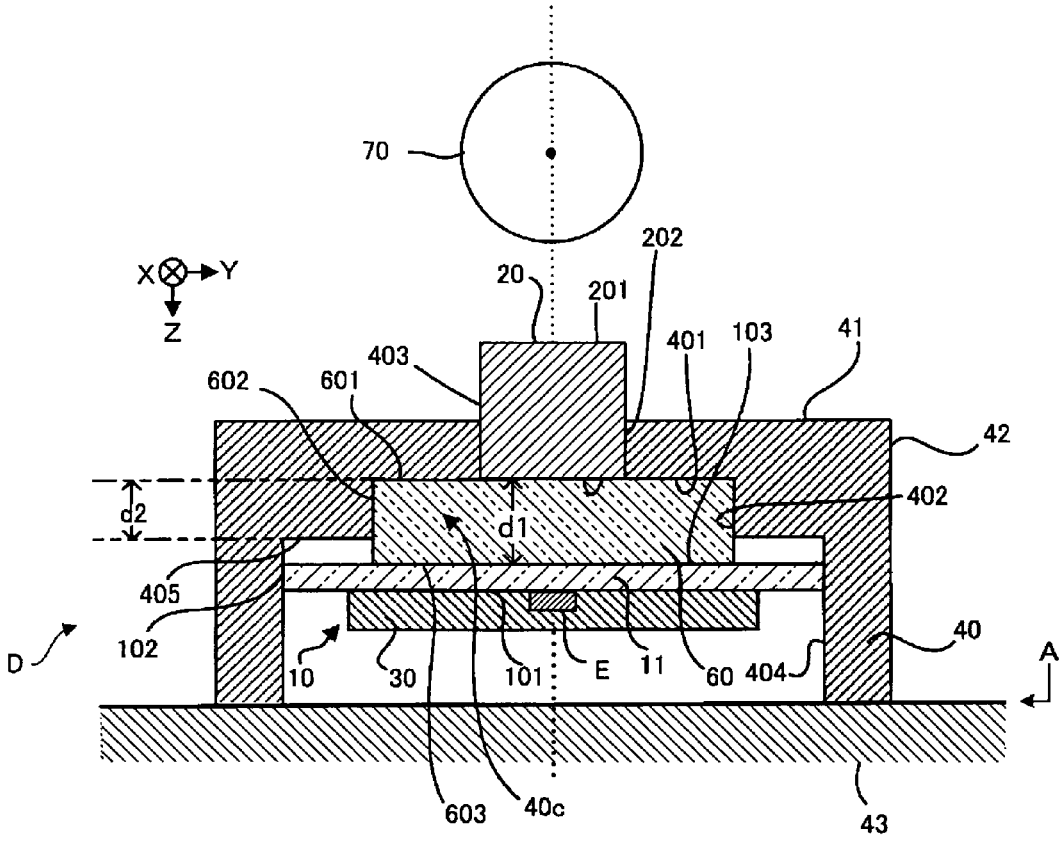
FIG. 3 is a cross-sectional view taken along line III-III of FIGS. 1 and 2.
Figure 4:
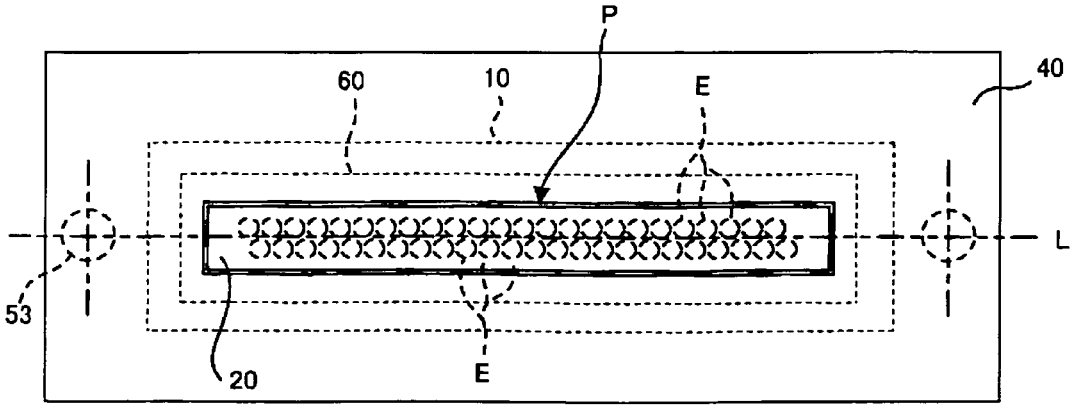
FIG. 4 is a plan view of the electro-optical apparatus.

FIG. 3 is a cross-sectional view taken along line III-III of FIGS. 1 and 2 and FIG. 4 is a plan view of the electro-optical apparatus D when being viewed from the side of the photosensitive drum 70. As shown in FIGS. 1 to 4, the electro-optical panel 10 includes an optically transparent substrate 11 the longitudinal side of which extends in the X direction, a plurality of electro-optical devices E which are arranged on a surface hereinafter, referred to as a "device arrangement surface") 101 of the substrate 11 opposite to the photosensitive drum 70 in a zigzag configuration or in two rows, and a sealant 30 fixed to the substrate 11 so as to cover the electro-optical devices E. The width (Y-directional dimension) of the sealant 30 is smaller than that of the substrate 11. Each electro-optical device E is a light-emitting device the light-emitting characteristics of which vary according to an electrical operation. The electro-optical device E according to the present embodiment is an organic light-emitting diode having a light-emitting layer made of an electroluminescence material and a cathode and an anode with the light-emitting layer interposed therebetween, which emits light with brightness corresponding to current supplied to the light-emitting layer.

The focusing lens array 20 is a rectangular parallelepiped member in which focusing lenses for focusing light emitted from the electro-optical devices E are arranged in an array. Each focusing lens is a cylindrical refractive-index-distribution-type lens having a refractive-index distribution from a central axis to a peripheral direction such that an optical axis (central axis) is aligned in a direction (Z direction) perpendicular to the device arrangement surface 101. The focusing lens array 20 transmits the light from the electro-optical panel 10 and forms an image on the surface of the photosensitive drum 70 as an erect image on the electro-optical panel 10. As the focusing lens array 20, a SELFOC lens array (SLA) available from Nippon Sheet Glass Co., Ltd. (SELFOC is a registered trade name of Nippon Sheet Glass Co., Ltd.) may be used.

The glass spacer 60 is a rectangular plate made of an optically transparent material such as glass or plastic. As shown in FIG. 4, the dimensions and the shape of the glass spacer 60 are selected so that it covers the plurality of electro-optical devices E arranged on the substrate 11 of the electro-optical panel 10. The width (Y-directional dimension) of the glass spacer 60 is smaller than that of the substrate 11 and larger than that of the focusing lens array 20.

As shown in FIGS. 1 to 4, the glass spacer 60 is in contact with the substrate 11 and the focusing lens array 20. A surface (hereinafter, referred to as a "first surface") 601 of the glass spacer 60 which faces the focusing lens array 20 is in contact with a surface (hereinafter, referred to as an "incident surface") 201 of the focusing lens array 20 which faces the electro-optical panel 10. A surface (hereinafter, referred to as a "second surface") 603 of the class spacer 60 which faces the electro-optical panel 10 is in contact with a surface (hereinafter, referred to as an "emission surface") 103 opposite to the device arrangement surface 101 of the substrate 11 on which the electro-optical devices E are arranged. That is, a relative distance between the electro-optical panel 10 and the focusing lens array 20 (distance between the electro-optical device E and the incident surface 201 of the focusing lens array 20) is defined by the thickness d1 (hereinafter, the thickness is referred to as the Z-directional dimension) of the glass spacer 60. The thickness d1 of the glass spacer 60 is defined by the refractive index of the glass spacer 60 and the operating distance of the electro-optical panel 10 of the focusing lens array 20 such that the image on the electro-optical panel 10 is substantially focused on the focusing lens array 20.

As shown in FIGS. 1 and 3, the electro-optical apparatus D further includes a frame 40. The frame 40 is a member including an upper surface portion 41 having a rectangular plate shape parallel to the installation surface A and side surface portions 42 which vertically extend from the circumference of the upper surface portion 41 to the installation surface A, which are integrally formed with each other. A bottom 43 of the side surface portion 42 of the frame 40 is bonded to the installation surface A. As shown in FIG. 3, the frame 40 receives the electro-optical panel 10, the glass spacer 60 and the focusing lens array 20 in a contact state. Accordingly, the surface of the side surface portion 42 of the frame 40 has a step shape having a step difference corresponding to the dimensions and the shapes of the electro-optical panel 10, the glass spacer 60 and the focusing lens array 20. The detailed shape of the frame 40 will now be described in detail.

As shown in FIG. 2, a recess 40*c* having a shape substantially equal to the outer shape of the glass spacer 60 is formed in the surface 405 of the upper surface portion 41 of the frame 40 on the side of the side surface 42. As shown in FIGS. 2 and 3, the glass spacer 60 is inserted into the recess 40*c*. In this state, the first surface 601 (a region except for a region which contacts the incident surface 201 of the focusing lens array 20) of the glass spacer 60 surface-contacts a bottom (hereinafter, referred to as a "first facing surface") 401 of the recess 40*c*. The Z-directional position of the glass spacer 60 is defined by allowing the first surface 601 to contact the first facing surface 401. Side surfaces 602 perpendicular to the first surface 601 of the glass spacer 60 surface-contact inner surfaces (hereinafter, referred to as "second facing surfaces") 402 of the recess 40*c* over the entire area thereof. The position and the orientation of the glass spacer 60 are defined in an X-Y plane by the contact with the second facing surface 402.

As shown in FIGS. 2 to 4, an opening P which penetrates through the upper surface portion 41 and extends from the surface of the photosensitive drum 70 to the first facing surface 401 is formed in the frame 40. As shown in FIG. 4, when viewed in the Z direction, the opening p has a rectangular shape substantially equal to the outer shape of the focusing lens array 20. As shown in FIG. 4, the opening P has a rectangular shape so as to surround the plurality of electro-optical devices E arranged on the substrate 11. The plurality of electro-optical devices E is provided on the inside of the focusing lens array 20. For convenience sake, the electro-optical devices E are indicated by dotted lines in FIG. 4.

The focusing lens array 20 is inserted into the opening P and fixed in a state where the incident surface 201 contacts the first surface 601 of the glass spacer 60. Accordingly, the Z-directional position of the focusing lens array 20 is defined. In this state, a side surface (a surface perpendicular to the incident surface 201) 202 of the focusing lens array 20 contacts an inner surface (hereinafter, referred to as a "third facing surfaced") 403 of the opening P over the entire area thereof. By this contact, the position and the orientation of the focusing lens array 20 are defined in the X-Y plane. The emission surface of the focusing lens array 20 protrudes from the upper surface portion 41 of the frame 40 to the photosensitive drum 70.

An inner surface (hereinafter; referred to as a "fourth facing surface) 404 of the side surface portion 42 when viewed in the Z direction is substantially aligned with to the side surface 102 of the substrate 11 of the electro-optical panel 10. The electro-optical panel 10 is received in the side surface portion 42 such that the side surface 102 of the substrate 11 contacts the fourth facing surface 404 over the entire area thereof.

As shown in FIG. 3, the distance d2 between the first facing surface 401 and the surface 405 (the depth of the recess 40*c*) is smaller than the thickness d1 of the glass spacer 60. Accordingly, the second surface 603 of the glass spacer 60 protrudes toward the electro-optical panel 10 when viewed from the surface 405. Thus, when the electro-optical panel 10 is received by the side surface portion 42 and moved in the Z direction, the emission surface 103 of the substrate 11 contacts the second surface 603 of the glass spacer 60 before reaching the surface 405. That is, the emission surface 103 does not contact the surface 405. Accordingly, the position of the substrate 11 relative to the frame 40 in the Z direction is defined by only the thickness d1 of the glass spacer 60 by fixing the electro-optical panel 10 in a state where the emission surface 103 contacts the second surface 603.

In the present embodiment, the first surface 601 and the first facing surface 401, the side surface 602 and the second facing surface 402, the emission surface 103 of the substrate 11 and the second surface 603, and the side surface 102 and the fourth facing surface 404 are bonded using an adhesive. Similarly, the side surface 202 of the focusing lens array 20 and the third facing surface 403, and the incident surface 201 and the first surface 601 are bonded using an adhesive. In the bonding, a thermosetting adhesive or an ultraviolet-curable adhesive is used. In the present embodiment, since the first surface 601 of the glass spacer 60 is perpendicular to the side surface 602, the first facing surface 401 is perpendicular to the second facing surface 402. The first facing surface 401 is parallel to the installation surface A. The second facing surface 402, the third facing surface 403 and the fourth facing surface 404 are perpendicular to the installation surface A.

As shown in FIGS. 1, 2 and 4, two support rods protruding from the upper surface portion 41 in the Z direction are provided on the frame 40. The central axis of each support rod 53 is perpendicular to a straight line L (for example, the central line of the substrate 11) according to the arrangement of the plurality of electro-optical devices E and the support rod is provided on the straight line L with the electro-optical panel 10 interposed therebetween in the X direction. In the present embodiment, the support rods 53 are integrally formed with the frame 40.

Bearings 52 are provided on the front ends of the support rods 53. The bearings 52 support both ends of a rotation shaft 51 of the photosensitive drum 70. By means of the above-described configuration, the photosensitive drum 70 is supported by the support rods 53 so as to rotate around the central axis R at the position spaced apart from the installation surface A by the predetermined interval.

As described above, the glass spacer 60 is interposed between the electro-optical panel 10 and the focusing lens array 20 to define the relative distance between the electro-optical panel 10 and the focusing lens array 20. Meanwhile, since the photosensitive drum 70 is supported by the upper surface portion 41 of the frame 40, the position of the photosensitive drum 70 in the Z direction is defined on the basis of the frame 40. Accordingly, when the first surface 601 of the glass spacer 60 contacts the first facing surface 401 of the frame 40 to define the position of the glass spacer 60 in the Z direction, the position of the incident surface 201 of the focusing lens array 20 is defined and the distance from the emission surface of the focusing lens array 20 (the emission surface of the electro-optical apparatus D) to the photosensitive drum 70 is also defined. Accordingly, the relative position of the first facing surface 401 in the Z direction is set such that the light emitted from the focusing lens array 20 forms a desired image on a light-receiving surface of the photosensitive drum 70.

By the contact with the frame 40 (the second facing surface 402, the third facing surface 403 and the fourth facing surface 404), the respective positions of the glass spacer 60, the focusing lens array 20 and the electro-optical panel 10 are defined in the X-Y plane. In the present embodiment, the second facing surface 402, the third facing surface 403 and the fourth facing surface 404 are defined such that the respective central lines of the glass spacer 60, the focusing lens array 20 and the substrate 11 are parallel to the central axis R (FIG. 1) of the photosensitive drum 70 in the same plane (the plane perpendicular to the installation surface A). Meanwhile, the central line of the substrate 11 is exactly aligned with the straight line L (FIG. 4) according to the arrangement of the plurality of electro-optical devices E and the central line of the focusing lens array 20 is exactly aligned with a straight line (not shown) according to the arrangement of the plurality of focusing lenses arranged in an array. Accordingly, an optical image formed by the light emitted from the plurality of electro-optical devices E passes through the focusing lenses to reach the surface of the photosensitive drum 70, thereby forming an image thereon as a desired image.

As described above, according to the electro-optical apparatus D related to the present embodiment, since the glass spacer 60 is interposed between the electro-optical panel 10 and the focusing lens array 20, the width of the flux of the light emitted from the electro-optical devices E is narrower, compared with a configuration in which air is filled between the electro-optical panel 10 and the focusing lens array 20. Accordingly, it is possible to increase a ratio (light use efficiency) of the amount of light incident to the focusing lens array 20 to the light emitted from the electro-optical panel 10.

The relative distance between the electro-optical panel 10 and the focusing lens array 20 is defined by the thickness d1 of the glass spacer 60, the electro-optical panel 10 and the focusing lens array 20 as well as the glass spacer 60 can be positioned at a predetermined position on the basis of the frame 40, by only allowing the surface the first surface 601) of the glass spacer 60 on the side of the photosensitive drum 70 to contact the first facing surface 401 of the frame 40. In the present embodiment, since the position of the photosensitive drum 70 is also defined on the basis of the frame 40, it is possible to simply define the position of the electro-optical panel 10 and the focusing lens array 20 relative to the photosensitive drum 70 with high precision.

Since the electro-optical panel 10 and the focusing lens array 20 are bonded to the glass spacer 60, stronger fixing is possible compared with a configuration in which the electro-optical panel 10 and the focusing lens array 20 only contact the glass spacer 60. In addition, a phenomenon that the electro-optical panel 10 becomes curved over time can be prevented.

Since the side surface 602 contacts the second facing surface 402, the position of the glass spacer 60 in the X-Y plane is simply defined by the frame 40. Since a portion of the glass spacer 60 which contacts the first facing surface 401 and a portion of the glass spacer 60 which contacts the second facing surface 402 are bonded by the adhesive, it is possible to prevent misalignment of the glass spacer 60 in all directions and to prevent misalignment of the electro-optical panel 10 and the focusing lens array 20. Accordingly, it is possible to stably form a latent image (a developed image) on the surface of the photosensitive drum 70 with high quality.

In the above configuration, since the position of the focusing lens array 20 in the X-Y plane is defined by the third facing surface 403 and the position of the electro-optical panel 10 in the X-Y plane is defined by the fourth facing surface 404, it is possible to simply define the positions of the electro-optical panel 10 and the focusing lens array 20 in the X-Y direction. Since the side surface 202 of the focusing lens array 20 is bonded to the third facing surface 403 by the adhesive and the side surface 102 of the substrate 11 of the electro-optical panel 10 is bonded to the fourth facing surface 404 by the adhesive, it is possible to strongly fix the electro-optical panel 10 and the focusing lens array 20 to the frame 40, compared with a case where the adhesive is not used.

Method of Manufacturing Electro-Optical Apparatus

Figure 5:
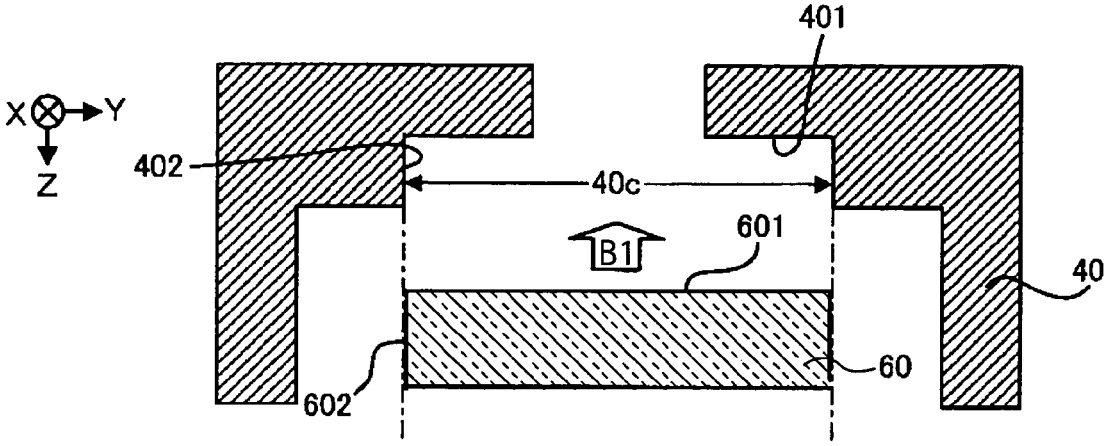
FIG. 5 is a view illustrating a step of a method of manufacturing the electro-optical apparatus.
Figure 6:
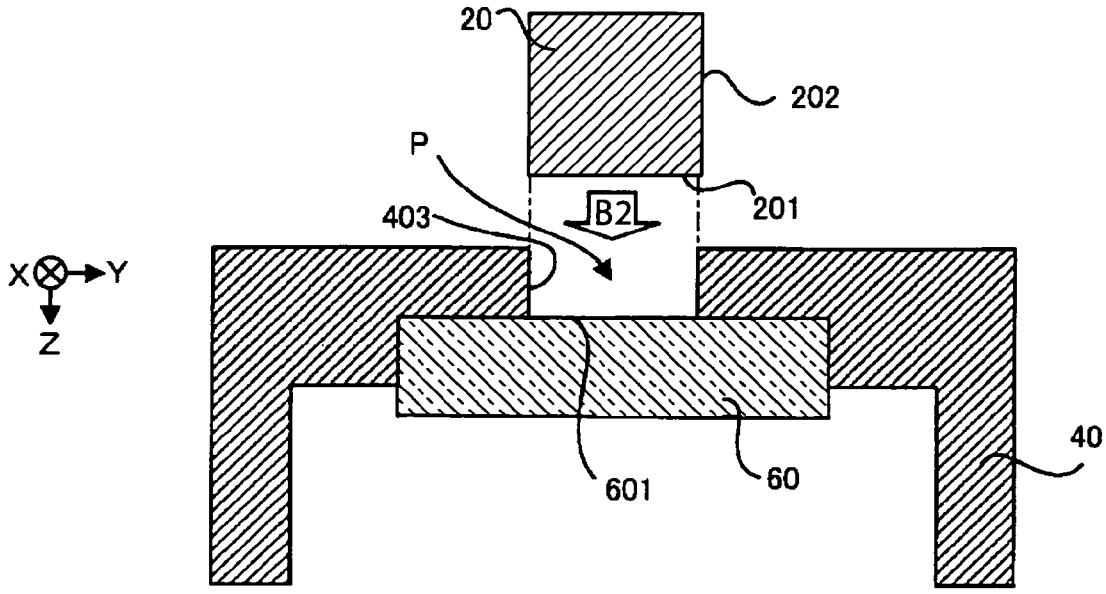
FIG. 6 is a view illustrating a step of the method of manufacturing the electro-optical apparatus.
Figure 7:
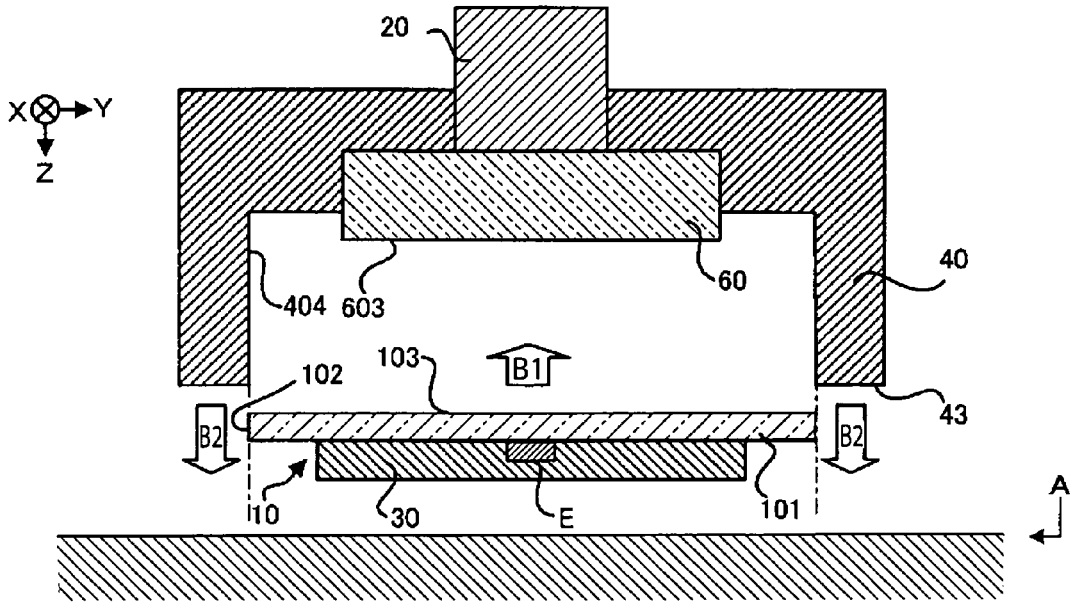
FIG. 7 is a view illustrating a step of the method of manufacturing the electro-optical apparatus.

Next, a method of manufacturing the above-described electro-optical apparatus D will be described. FIGS. 5 to 7 are views illustrating first to third steps of the method of manufacturing the electro-optical apparatus D. In the first step shown in FIG. 5, the glass spacer 60 is mounted. In the second step shown in FIG. 6, the focusing lens array 20 is mounted. In the third step shown in FIG. 7, the electro-optical panel 10 is mounted.

First, the distance between the focusing lens array 20 and the electro-optical panel 10 is defined on the basis of the operating distance of the focusing lens array 20 and the refractive index of the glass spacer 60 and the glass spacer 60 having the thickness d1 corresponding to the defined distance is prepared. Subsequently, as shown in FIG. 5, the prepared glass spacer 60 is moved and inserted into the recess 40*c* in a direction indicated by an arrow B3 in the drawing and is further moved in a state where the side surface 602 contacts the second facing surface 402. The glass spacer 60 is fixed to the frame 40 in a state where the first surface 601 contacts the first facing surface 401. The glass spacer 60 and the frame 40 are bonded by the adhesive previously coated on the first facing surface 401 and the second facing surface 402 (or the first surface 601 and the side surface 602).

Next, as shown in FIG. 6 the focusing lens array 20 is moved and inserted into the opening P in a direction indicated by an arrow B2 in the drawing and is further moved in a state where the side surface 202 contacts the third facing surface 403. The focusing lens array 20 is fixed to the frame 40 and the glass spacer 60 in a state where the incident surface 201 of the focusing lens array 20 contacts the first surface 601 of the glass spacer 60. The focusing lens array 20, the frame 40 and the glass spacer 60 are bonded by the adhesive previously coated on the third facing surface 403 and the first surface 601 (or the incident surface 201 and the side surface 202 of the focusing lens array 20).

Subsequently, as shown in FIG. 7, the electro-optical panel 10 is moved in a direction indicated by the arrow B1 in the drawing and is further moved in the direction indicated by the arrow B1 in a state where the side surface 102 of the substrate 11 contacts the fourth facing surface 404 of the frame 40. The emission surface 103 of the substrate 11 is fixed so as to contact the second surface 603 of the glass spacer 60. The substrate 11 and the frame 40, and the frame 40 and the glass spacer 60 are bonded by the adhesive previously coated on the second surface 603 and the fourth facing surface 404 (or the emission surface 103 and the side surface 102 of the substrate 11).

When fabrication of the electro-optical apparatus D is completed by the above-described steps, the frame 40 is moved in the direction indicated by the arrow B2 in the drawing such that the bottom 43 is fixed to the installation surface A. The bottom 43 and the installation surface A are bonded by the adhesive previously coated on the bottom 43 or the installation surface A. The photosensitive drum 70 is mounted on the supporting rods 53 of the frame 40 such that the arrangement direction (straight line L) of the electro-optical devices E is parallel to the central axis R of the photosensitive drum 70.

As described above, in the manufacturing method according to the present embodiment, the glass spacer 60 is first mounted on the frame 40 and fixed at a predetermined position. Then, the focusing lens array 20 and the electro-optical panel 10 are mounted so as to contact the glass spacer 60 (on the basis of the glass spacer 60). Accordingly, it is possible to simply arrange the electro-optical panel 10 and the focusing lens array 20 at the predetermined positions with high precision.

MODIFIED EXAMPLE

The above-described embodiment may be variously changed. The modified examples will now be described. The examples may be properly combined.

(1) Modified Example 1

In the above-described embodiment, the photosensitive drum 70 is supported by the support rods 53 integrally formed with the upper surface portion 41 of the frame 40. However, when the relative misalignment between the support rods 53 and the upper surface portion 41 is not problematic, the support rods 53 may be separated from the frame 40. In this configuration, the support rods 53 may be mounted on the frame 40 (the upper surface portion 41) or another portion (for example, the installation surface A).

(2) Modified Example 2

Although the frame 40 surrounds the electro-optical panel 10, the focusing lens array 20 and the glass spacer 60 over the entire circumference in the above-described embodiment, the shape of the frame 40 may be defined to define only the position in the Z, direction when another mechanism for defining the glass spacer 60 in the X-Y plane is mounted. That is, the frame 40 may not have the step shape and may have only the first facing surface. Similarly, the positions of the electro-optical panel 10 and the focusing lens array 20 in the X-Y plane are not necessarily defined by the frame 40.

(3) Modified Example 3

Although the emission surface 103 of the electro-optical panel 10 contacts the second surface 603 of the glass spacer 60 in the above-described embodiment, the emission surface 103 may contact the surface 405 of the frame 40 on the side of the electro-optical panel 10, instead of the second surface 603. At this time, the thickness d1 of the glass spacer 60 may be equal to or smaller than the distance d2.

(4) Modified Example 4

In the above-described embodiment, the method of manufacturing the electro-optical apparatus is performed in order of the steps of mounting the glass spacer 60, mounting the focusing lens array 20 and mounting the electro-optical panel 10. However, the order of the steps of mounting the focusing lens array 20 and the electro-optical panel 10 may be reversed.

(5) Modified Example 5

In the above-described embodiment, as an example of the electro-optical panel 10, a configuration (a bottom emission type) in which the plurality of electro-optical devices E are arranged on the surface of the substrate 11 opposite to the photosensitive drum 70 and the substrate 11 is positioned closer to the photosensitive drum 70 than the sealant 30 was described. However, another configuration may be employed as the electro-optical panel 10. For example, a configuration (a top emission type) in which the plurality of electro-optical devices E are arranged on the surface of the substrate 11 on the side of the photosensitive drum 70 and the electro-optical devices E are covered by the sealant 30 may be employed. When the width (Y-directional width) of the sealant 30 is larger than that of the substrate 11, the sealant 30 may contact the fourth facing surface 404, instead of the substrate 11.

(6) Modified Example 6

Although the contact surfaces of the glass spacer 60, the focusing lens array 20, the electro-optical panel and the frame 40 are bonded by the adhesive in the present embodiment, they may not be bonded when a support mechanism is properly provided. A configuration in which the relative position between the components may be stably defined may be employed.

(7) Modified Example 7

In the invention, the electro-optical device is a component in which optical characteristics such as brightness or a transmission factor vary depending on the application of electric energy. In the electro-optical device according to the invention, a self-emission type device for emitting light or a non-light-emitting type device for changing the transmission factor of external light, or a current driving type device which is driven by supplying current or a voltage driving type device which is driven by applying a voltage may be used. For example, instead of the OLED described in the above-described aspects, an inorganic electroluminescence (ETL) device, a field emission (FE) device, a surface-conduction electron-emitter (SE) device, a ballistic electron surface emitting (BS) device, a light-emitting diode (LED), a liquid crystal device, an electrophoretic device, an electrochromic device or the like may be used in the invention.

Applications

Next, an image-forming apparatus will be described as an example of an electronic apparatus using the electro-optical apparatus according to the invention.

Figure 8:
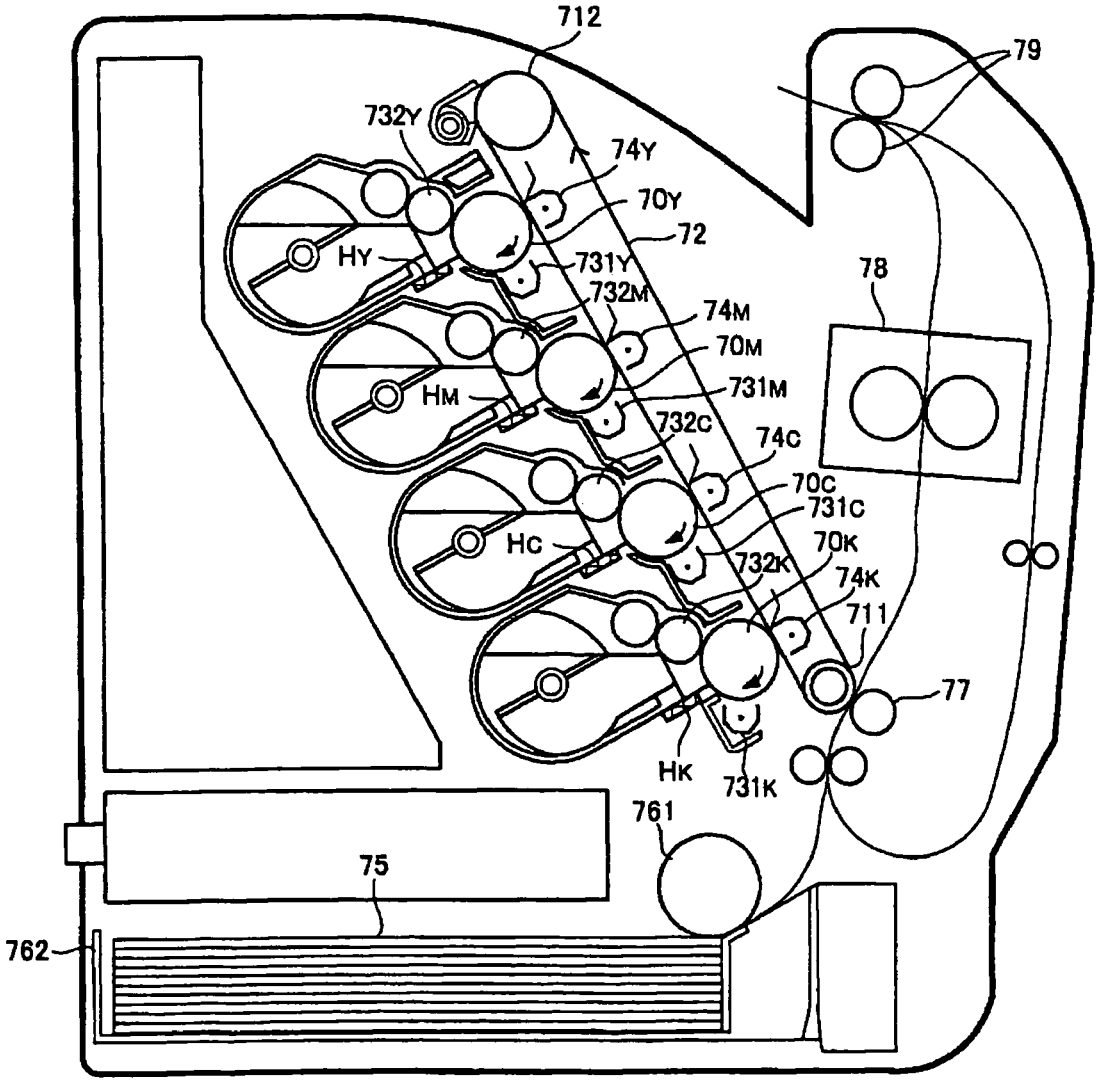
FIG. 8 is a longitudinal cross-sectional view showing the configuration of an image-forming apparatus.

FIG. 8 is a cross-sectional view showing the configuration of the image-forming apparatus which employs the electro-optical apparatus D related to the above-described aspects as an exposure head. The image-forming apparatus is a tandem type full-color image-forming apparatus, which includes four electro-optical apparatus D (DK, DC, DM and DY) related to the above-described aspects and four photosensitive drums 70 (70K, 70C, 70M and 70Y) corresponding to the electro-optical apparatus D. One electro-optical apparatus D is disposed to face an image forming surface (outer circumferential surface) of the photosensitive drum 70 corresponding thereto. Additional characters K, C, M and Y of the reference numerals indicate members which are used in forming the developed images of black (K), cyan (C), magenta (M) and yellow (Y).

As shown in FIG. 8, an endless intermediate transfer belt 72 is wound on a driving roller 711 and a driven roller 712. The four photosensitive drums 70 are disposed in the vicinity of the intermediate transfer belt 72 at a predetermined gap. The photosensitive drums 70 rotate in synchronization of the driving of the intermediate transfer belt 72.

Corona chargers 731 (731K, 731C, 731M and 731Y) and developers 732 (732K, 732C, 732M and 732Y) are disposed in the vicinity of the photosensitive drums 70, in addition to the electro-optical apparatus D. The corona chargers 731 uniformly charge the image forming surfaces of the photosensitive drums 70 corresponding thereto. The charged image forming surfaces are exposed to the electro-optical apparatus D to form electrostatic latent images. The developers 732 attach developing agents (toners) to the electrostatic latent images to form developed images (visible image) on the photosensitive drums 70.

As described above, the developed images of respective colors (black, cyan, magenta and yellow) formed on the photosensitive drums 70 are sequentially transferred primary transfer) onto the surface of the intermediate transfer belt 72 to form a full-color developed image. Four primary transfer corotorons (transfer units) 74 (74K, 74*c*, 74M and 74Y) are disposed at the inside of the intermediate transfer belt 72. Each primary transfer corotoron 74 electrostatically sucks the developed image from the photosensitive drum 70 corresponding thereto to transfer the developed image to the intermediate transfer belt 72 which passes through the gap between the photosensitive drum 70 and the primary transfer corotoron 74.

A sheet (recording material) 75 is fed from a feed cassette 762 by a pickup roller 761 one sheet by one sheet and carried to a nip between the intermediate transfer belt 72 and a secondary transfer roller 77. The full-color developed image formed on the surface of the intermediate transfer belt 72 is transferred (secondary transfer) onto one surface of the sheet 75 by the secondary transfer roller 77 and is fixed on the sheet 75 by passing through a pair of fixing rollers 78. A pair of ejection rollers 79 ejects the sheet 75 on which the developed image is fixed by the above-described steps.

Since the above-described image-forming apparatus uses the OLED as a light source (exposure means) the apparatus has a size smaller than that of a configuration using a laser scanning optical system. The invention is applicable to an image-forming apparatus having the other configuration. For example, a rotary development type image-forming apparatus or the intermediate transfer belt is not used. The electro-optical apparatus related to the invention can be used in an image-forming apparatus for directly transferring a developed image from a photosensitive drum onto a sheet or an image-forming apparatus for forming a monochromic image.

The use of the electro-optical apparatus related to the invention is not limited to the exposure of an image carrier. For example, the electro-optical apparatus according to the invention is employed in an image reading apparatus as a line-type optical head (illumination apparatus) for irradiating light onto a read target such as an original. This image reading apparatus includes a scanner, a copier, a reading part of a facsimile, a barcode reader or a two-dimensional image code reader for a two-dimensional image code such as a QR code (registered trade name).

The entire disclosure of Japanese Patent Application No. 2006-082256, filed Mar. 24, 2006 is expressly incorporated by reference herein.

What is claimed is:

1. An electro-optical apparatus comprising:

an electro-optical panel on which a plurality of electro-optical devices are arranged;

a focusing lens array which focuses light emitted from the electro-optical devices;

an optically transparent spacer which is interposed between the electro-optical panel and the focusing lens array and contacts the electro-optical panel and the focusing lens array; and a frame which has a first facing surface facing a first surface which is a surface of the spacer on the side of the focusing lens array, wherein the first surface contacts the first facing surface.

2. The apparatus according to claim 1, wherein the frame has a second facing surface facing a side surface of the spacer and the second facing surface contacts the side surface of the spacer.

3. The apparatus according to claim 1, wherein the frame has a third facing surface facing a side surface of the focusing lens array and the third facing surface contacts the side surface of the focusing lens array.

4. The apparatus according to claim 1, wherein the frame has a fourth facing surface facing a side surface of the electro-optical panel and the fourth facing surface contacts the side surface of the electro-optical panel.

5. The apparatus according to claim 1, wherein the spacer is bonded to the first facing surface or at least any of the first and second facing surfaces of the frame.

6. The apparatus according to claim 1, wherein the spacer is bonded to at least any of the electro-optical panel and the focusing lens array.

7. An image-forming apparatus comprising:

an image carrier;

a charger which charges the image carrier;

the electro-optical apparatus according to claim 1, which irradiates the light emitted from the electro-optical devices onto a charged surface of the image carrier to form a latent image;

a developer which forms a developed image on the image carrier by attaching a developing agent to the latent image; and a transfer unit which transfers the developed image from the image carrier to another object.

8. A method of manufacturing an electro-optical apparatus which includes an electro-optical panel on which a plurality of electro-optical devices are arranged; a focusing lens array which focuses light emitted from the electro-optical devices; an optically transparent spacer which is interposed between the electro-optical panel and the focusing lens array and contacts the electro-optical panel and the focusing lens array; and a frame which has a first facing surface facing a surface which is a surface of the spacer on the side of the focusing lens array, the method comprising:

a first step of allowing a first surface which is the surface of the spacer on the side of the focusing lens to contact the first facing surface; and a second step of allowing a second surface which is a surface of the spacer on the side of the electro-optical panel to contact the electro-optical panel and allowing the focusing lens to contact the first surface.

9. The method according to claim 8, wherein the frame has a second facing surface facing a side surface of the spacer and the side surface of the spacer contacts the second facing surface in the first step.

10. The method according to claim 8, wherein the spacer is bonded to at least any of the first and second facing surfaces of the frame in the first step.

11. The method according to claim 8, wherein at least any of the electro-optical panel and the focusing lens is bonded to the spacer in the second step.

* * * * *